US006458219B2

(12) United States Patent
Chihara et al.

(10) Patent No.: US 6,458,219 B2
(45) Date of Patent: Oct. 1, 2002

(54) METAL SURFACE-TREATING METHOD

(75) Inventors: Hiroshi Chihara, Kawasaki (JP); Kenji Tsuge, Yokohama (JP); Yutaka Kinose, Tokyo (JP); Toru Hata, Tokyo (JP); Eriko Okuno, Tokyo (JP); Takahiro Nagayama, Tokyo (JP)

(73) Assignees: Nippon Paint Co., Ltd., Osaka (JP); Nippon Chemical Industrial Co., Ltd., Tokyo (JP)

( * ) Notice: Subject to any disclaimer, the term of this patent is extended or adjusted under 35 U.S.C. 154(b) by 0 days.

(21) Appl. No.: 09/853,598

(22) Filed: May 14, 2001

(30) Foreign Application Priority Data

May 15, 2000 (JP) ..... 2000-141313
Jan. 17, 2001 (JP) ..... 2001-008717

(51) Int. Cl.[7] ..... C23C 22/12

(52) U.S. Cl. ..... 148/262; 148/273

(58) Field of Search ..... 148/253, 262, 148/273

(56) References Cited

U.S. PATENT DOCUMENTS 3,939,014 A 2/1976 Reed
5,203,930 A * 4/1993 Blumlhuber et al. ..... 148/262

FOREIGN PATENT DOCUMENTS

EP 0 055 615 7/1982
EP 0 414 301 2/1991
JP 55054576 4/1980

OTHER PUBLICATIONS

European Search Report for EP 01 40 1238.

* cited by examiner

*Primary Examiner*—John Sheehan
*Assistant Examiner*—Andrew L. Oltmans

(57) ABSTRACT

This invention provides a metal surface-treating method which comprises a chemical conversion step of dipping a substrate in an acidic aqueous zinc phosphate solution, and using an aqueous zinc nitrite solution as an accelerator, said aqueous zinc nitrite solution being substantially free of calcium ion and containing 0 to 6500 ppm of sodium ion and 0 to 20 ppm of sulfate ion in case of assuming the concentration of zinc nitrite $[Zn(NO_2)_2]$ therein to be 10 weight % as $NO_2$.

11 Claims, 1 Drawing Sheet

A1, A2 : Anion exchange membrane

C1, C2 : Cation exchange membrane

A1, A2 : Anion exchange membrane

C1, C2 : Cation exchange membrane

METAL SURFACE-TREATING METHOD

FIELD OF THE INVENTION

The present invention relates to a method for zinc phosphate surface chemical conversion treatment of metal products such as automotive bodies, household electrical appliances and steel furniture.

BACKGROUND OF THE INVENTION

Metallic products such as automotive bodies, household electrical appliances, steel furniture, etc. are generally subjected to a zinc phosphate chemical conversion treatment prior to coating. While this treatment is generally carried out by a spray technique or a dip technique, dip chemical conversion followed by cationic electrocoating is the coating system generally applied to metallic substrates having an intricate surface structure and calling for a corrosion-resistant surface after coating as it is true of automotive bodies. Regarding the substrate as such, one having both an iron type surface and a zinc type surface is usually applied thereto.

The conventional process for zinc-phosphating metallic substrates comprises a sequence of degreasing-aqueous cleaning-aqueous cleaning-chemical conversion-aqueous cleaning-aqueous cleaning. In the chemical conversion stage, the treating agent is replenished to make up for its consumption due to the chemical conversion and carry-over loss of said agent so as to control the concentrations of zinc and other metal ions, total acidity, acid ratio and other process parameters at constant values. Furthermore, the $NO_2$ concentration of the treating bath is maintained at a constant amount generally by feeding an aqueous solution of sodium nitrite as a chemical conversion accelerator. However, such a bath management procedure is not only uneconomical in that the sodium ion unnecessary for chemical conversion must be added but also disadvantageous in that the increase in sodium ion concentration elevates the pH of the treating bath to cause precipitation of chemical conversion film-forming components in the treating bath. Moreover, $NO_2$ in the treating agent is oxidized to the nitrate ion to thereby increase the nitrate ion concentration of the treating agent.

Meanwhile, in the phosphating line in general use today, where a portion of the treating agent is carried over to the aqueous cleaning stage as mentioned above, the accumulation of sodium and nitrate ions beyond the necessary levels in the treating agent may be prevented and a balance of treating agent ion concentrations maintained by supplementing the treating agent at rates commensurate with consumption due to carry-overs. However, as the amount of carry-overs of any component of the treating agent solution to the following cleaning stage is diminished and some of the composition is built up because of disagreement between the composition of the reagent replenished and the process conditions of the chemical conversion treatment line, the balance between consumption and supply of treating agent components is disturbed. By way of illustration, there are cases in which sodium ions and nitrate ions are built up to abnormal levels, with the result that such chemical conversion defects as yellow rust and thin spots may take place. Therefore, if nitrous acid could be used in lieu of sodium nitrite as a chemical conversion accelerator, the accumulation of sodium ions would be successfully avoided. Actually, however, nitrous acid is so labile that it cannot exist under ordinary conditions and, therefore, cannot be utilized as an accelerator.

Moreover, in the above chemical conversion line, carry-overs of the treating agent solution are washed off with a large quantity of water and discharged out of the line and this entails troubles in the conservation of water resources and environment. To overcome these disadvantages, there has been developed a system such that the aqueous cleaning stage is constituted as a multi-stage system and the washings overflowing the downstream cleaning stage is recycled as cleaning water to the upstream stage to thereby economize the cleaning water or a system such that the washings discharged from the chemical conversion line are recovered in a closed system including a reverse osmosis stage or an evaporation stage and reused as the reagent solution to be fed to the chemical conversion bath and/or as cleaning water. In these systems, however, if an aqueous solution of sodium nitrite is fed as said accelerator to the zinc phosphate chemical conversion bath, the sodium ion tends to be accumulated in the treating agent and this has been a major drawback in the use of a closed system.

Previously, in JP Application 2000-141893, the inventors of the present invention proposed an aqueous zinc nitrite solution which is substantially free of sodium and sulfate ions and, as such, is of use as a metal surface chemical conversion accelerator, said solution being obtainable by the reaction of zinc nitrate with calcium nitrite and subsequent purification.

SUMMARY OF THE INVENTION

The present invention has for its object to provide a metal surface-treating method which comprises forming a zinc phosphate film compatible with the subsequent cationic electrocoating of a shaped product of metal, particularly a metal product having both an iron type metallic surface and a zinc type metallic surface, and which leads itself well to the implementation of a closed system.

The present invention, therefore, is directed to a metal surface-treating method which comprises a chemical conversion step of dipping a substrate in an acidic aqueous zinc phosphate solution, and uses an aqueous zinc nitrite solution as an accelerator, said aqueous zinc nitrite solution being substantially free of calcium ion and containing 0 to 6500 ppm of sodium ion and 0 to 20 ppm of sulfate ion in case of assuming the concentration of zinc nitrite $[Zn(NO_2)_2]$ in said aqueous zinc nitrite solution to be 10% by weight as $NO_2$.

The acidic aqueous zinc phosphate solution mentioned above may contain 0.5 to 2 g/L of zinc ion, 5 to 30 g/L of phosphate ion, 0.2 to 2 g/L of manganese ion and 0.05 to 0.3 g/L as $NO_2$ of zinc nitrite.

Further, the acidic aqueous zinc phosphate solution mentioned above may contain 0.3 to 2 g/L of nickel ion.

Furthermore, the acidic aqueous zinc phosphate solution mentioned above may contain 3 to 30 g/L of nitrate ion.

The substrate mentioned above is preferably a metal product having an iron type surface and a zinc type surface or one having an iron type surface, a zinc type surface and an aluminum type surface.

DETAILED DESCRIPTION OF THE INVENTION

Figure 1:
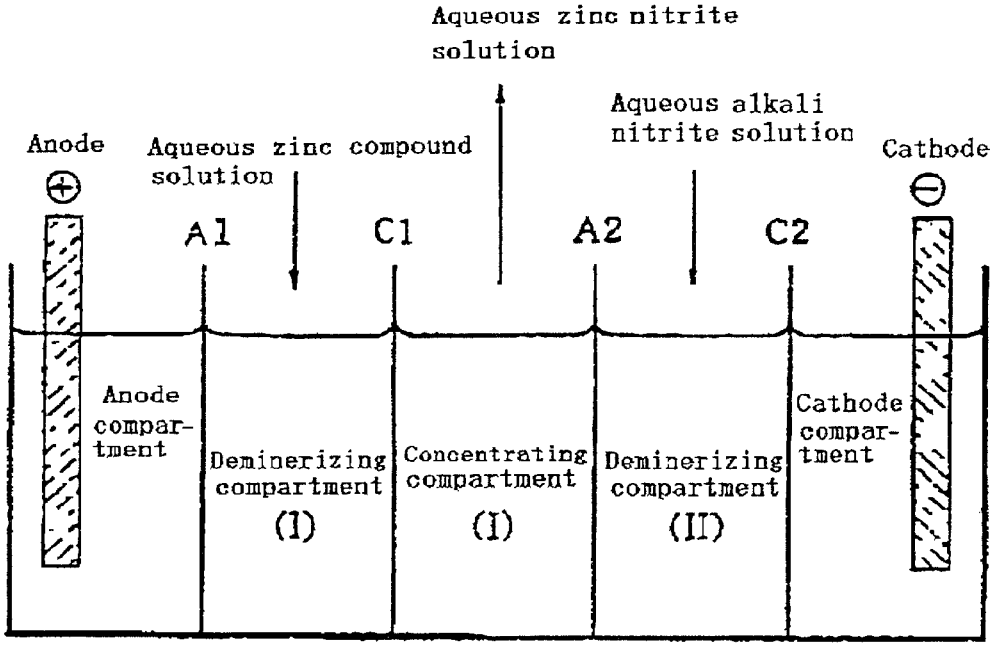
FIG. 1 is a schematic view showing the electrodialyzer used in Preparation Example 1.

In the metal surface-treating method of the invention, an aqueous solution of zinc nitrite $[Zn(NO_2)_2]$ is used. The above aqueous solution of zinc nitrite is added, as an accelerator, to said acidic zinc phosphate solution and replenished as needed. In a metal surface treatment, an accelerator is generally added to a chemical conversion agent for promoting the chemical conversion film-forming reaction on the metal surface and not only allows chemical conversion to take place at low temperature but also is effective in reducing the chemical conversion time.

The aqueous zinc nitrite solution mentioned above contains 5 to 40 weight % of $NO_2$ relative to its total weight. If the $NO_2$ content is less than 5 weight %, the accelerator solution must be replenished in an undesirably large amount during the chemical conversion treatment. If it exceeds 40 weight %, the concentrations of sodium ion and sulfate ion as impurities are increased in the preparation of said aqueous zinc nitrite solution to adversely affect the chemical conversion film. The preferred $NO_2$ content is 9 to 20 weight %.

When the $NO_2$ concentration in said aqueous zinc nitrite solution is 5 to 40 weight %, preferably 9 to 20 weight %, the zinc ion concentration is 4 to 28 weight %, preferably 6 to 14 weight %, and the zinc nitrite concentration is 9 to 68 weight % preferably 15 to 34 weight %.

The above aqueous zinc nitrite solution is substantially free of calcium ion. If a calcium ion is present during the acceleration of chemical conversion, for example when said zinc nitrite solution is mixed with the zinc phosphate chemical conversion agent, a sludge is formed due to precipitation of calcium phosphate in the surface-treating agent. While such a sludge is usually recovered from the treating bath periodically to prevent accumulation in the treating bath, such a sludge recovery procedure complicates the process and is industrially unwelcome. The expression "substantially free of calcium ion" as used in this specification means that the concentration of calcium ion in said aqueous zinc nitrite solution as measured by ICP emission spectrometry is not more than 100 ppm, preferably not more than 10 ppm.

The aqueous zinc nitrite solution sometimes contains sodium ion and/or sulfate ion as impurity. The tolerable amounts of sodium ion and sulfate ion in the aqueous zinc nitrite solution, assuming the concentration of zinc nitrite in the aqueous zinc nitrite solution to be 10 weight % as $NO_2$, are 0 to 6500 ppm, preferably 0 to 4000 ppm, usually 500 to 2000 ppm, for sodium ion, and 0 to 20 ppm, preferably 0 to 15 ppm, for sulfate ion.

If the concentration of sodium ion or sulfate ion exceeds the above upper limit, the sodium ion or sulfate ion accumulates in the zinc phosphate chemical conversion treating agent as the accelerator is replenished, thus exerting untoward effects on chemical conversion. Such untoward effects are particularly serious when the chemical conversion treatment is carried out in a metal surface-treating line using a closed system intended for reducing cleaning water requirements or permitting reuse of cleaning water, such as a multi-stage aqueous cleaning system, a reverse osmosis system or an evaporation system.

The sodium ion concentration is measured by atomic absorption spectrometry. The sulfate ion is determined by assaying sulfur (S) by ICP emission spectrometry and converting the value to sulfate ion.

The method of producing the aqueous zinc nitrate solution comprises a first step in which a soluble zinc compound and a soluble alkali nitrite compound are subjected to double decomposition using ion exchange membranes as diaphragms to electrolytically synthesize an aqueous nitrous acid solution and a second step in which the aqueous nitrous acid solution thus produced is purified.

The above first step is carried out preferably as follows. Thus, using a multi-cell electrodialyzer comprising unit cells each having one concentrating compartment and two demineralizing compartments flanking said concentrating compartment as constituted by the alternate arrangement of cation exchange and anion exchange membranes between the anode and the cathode, the anode side and cathode side of each demineralizing compartment being formed of the anion exchange membrane and cation exchange membrane, respectively, an aqueous zinc compound solution is fed to the demineralizing compartment on the anode side while an aqueous alkali nitrite solution is fed to the demineralizing compartment on the cathode side and an electric current is passed across the electrodes, whereby zinc ion is caused to migrate into the concentrating compartment flanked by said demineralizing compartments through the cation exchange membrane while $NO_2$ is caused to migrate into the concentrating compartment through the anion exchange membrane to give the objective aqueous zinc nitrite solution. Referring to the above first step, the reaction temperature is 10 to 50° C., the current density is 1.0 $A/dm^3$ to limiting current density, and the current time, though not particularly restricted, is about 10 to 50 hours.

The aqueous zinc compound solution is prepared by dissolving a soluble zinc compound in water. The zinc compound is not particularly restricted but may for example be zinc sulfate, zinc nitrate, zinc chloride and zinc acetate, and such compounds may be used singly or in combination. Among the above-mentioned compounds, zinc sulfate is preferred from the standpoint of commercial availability.

The concentration of said aqueous zinc compound solution is not particularly restricted but is preferably not over the saturation concentration at room temperature, more preferably 0.5 to 2.0 moles/L, still more preferably 0.9 to 1.3 moles/L.

The aqueous alkali nitrite solution, another raw material, is prepared by dissolving an alkali nitrite in water. The alkali nitrite is not particularly restricted but may for example be sodium nitrite, potassium nitrite or lithium nitrite, and these may be used singly or in combination. Among these compounds, sodium nitrite is preferred from the standpoint of commercial availability.

The concentration of said aqueous solution of a soluble alkali nitrite is not particularly restricted but is preferably not higher than the saturation concentration at room temperature, more preferably 1.5 to 6.0 moles/L, still more preferably 3.0 to 4.5 moles/L.

The cation exchange membrane mentioned above is not particularly restricted but may for example be a cation exchange membrane which is usually employed for electrolytic synthesis. Thus, for example, Selemion CMV (product of Asahi Glass Co.), Neocepta CM-1 (product of Tokuyama Co.) and Nafion 324 (product of DuPont) may be mentioned, The anion exchange membrane mentioned above is not particularly restricted, either, but may for example be an anion exchange membrane which is conventionally used for electrolytic synthesis. Thus, for example, Selemion AMV (product of Asahi Glass Co.) and Neocepta AM-1 (product of Tokuyama Co.) may be mentioned.

The anode and cathode for use in said electrodialyzer may each be made of a suitable material in a suitable configuration depending on the material and electrodialysis cell geometry, and as the material, a metallic material such as platinum, iron, copper or lead or a carbonaceous material can be employed.

In the above electrodialyzer, the anode compartment including said anode and defined by said electrodialysis cell and anion exchange membrane and the cathode compartment including said cathode and defined by said electrodialysis cell and cation exchange membrane are supplied with an electrolyte such as $Na_2SO_4$, NaCl or $NH_4Br$.

The concentration of the aqueous zinc nitrite solution obtained in said concentrating compartment rises as the current time is extended but the sodium ion and sulfate ion concentrations of the aqueous zinc nitrite solution based on 10 weight % of $NO_2$ also tend to rise. Therefore, it is recommendable to control the current time so that the sodium ion concentration will be 0 to 6500 ppm and the sulfate ion concentration be 0 to 20 ppm.

In the above method of preparing the aqueous zinc nitrite solution, the second step mentioned above can be carried out by using the conventional purification technique. This second step includes a procedure for removing excess ions from said aqueous nitrous acid solution so as to bring them into the above-mentioned ranges; for example when the concentration of sulfate ion in the aqueous nitrous acid solution obtained by said first step is higher that 20 ppm assuming the concentration of the aqueous nitrous acid solution to be 10 weight % $NO_2$, said second step includes a procedure of removing an excess of sulfate ion so that the residual sulfate ion concentration will be 0 to 20 ppm.

The technology of removing such an excess ion to purify the solution, taking the removal of sulfate ion as an example, includes a method (1) which comprises adding a barium ion to the solution to precipitate the sulfate ion as barium sulfate, a method (2) which comprises passing the solution through a cation exchange resin or an anion exchange resin, and a method (3) which comprises a solvent extraction procedure. The first-mentioned method (1) is preferred, however.

In the above method (1), it is sufficient to add a slight excess of barium ion relative to the residual sulfate ion and the addition amount relative to the residual sulfate ion may for example be 1.05 to 1.5 equivalents, preferably 1.05 to 1.2 equivalents.

The aqueous zinc nitrite solution obtained by the above method is added as a chemical conversion accelerator to the acidic aqueous zinc phosphate solution which is a chemical conversion agent for the formation of a zinc phosphate film on the metal surface.

In applying said aqueous zinc nitrite solution for the formation of a zinc phosphate film, $NO_2$ of the zinc nitrite produces an accelerating effect similar to that of the $NO_2$ of sodium nitrite in the zinc phosphate film-forming treating bath and zinc ion is a main component of the zinc phosphate film. Therefore, both the anion and cation of zinc nitrite may respectively display their own functions as surface-treating agents.

The acidic aqueous zinc phosphate solution mentioned above is not particularly restricted but may for example be an acidic zinc phosphate treating agent which is conventionally employed. The preferred treating agent contains 0.5 to 2 g/L, preferably 0.7 to 1.2 g/L, of zinc ion; 5 to 30 g/L, preferably 10 to 20 g/L, of phosphate ion; and 0.2 to 2 g/L, preferably 0.3 to 1.2 g/L, of manganese ion.

When the zinc ion concentration is less than 0.5 g/L, thin spots and yellow rust tend to develop in the phosphate film and detract from the corrosion resistance after coating. When it exceeds 2 g/L, the coating adhesion tends to be inadequate in case of a shaped product having a zinc type metallic surface.

When the phosphate ion amount is below 5 g/L, the variation in bath composition is increased so that no satisfactory film will be produced consistently. When it exceeds 30 g/L, no further effect commensurate with its content may be obtained and the increased reagent requirements become an economic disadvantage.

When the manganese ion amount is below 0.2 g/L, the coating adhesion and corrosion resistance tend to be inadequate in case of a zinc type metallic surface. When it exceeds 2 g/L, no further effect commensurate with the increased content will be obtained, resulting in an economic disadvantage.

An improvement can be obtained in the corrosion resistance by insuring that said acidic aqueous zinc phosphate solution further contains 0.3 to 2 g/L, preferably 0.5 to 1.5 g/L, of nickel ion and/or 0.05 to 3 g/L, preferably 0.3 to 1.5 g/L, in terms of HF, of a fluorine compound.

The combined use of nickel ion and manganese ion leads to a further improvement in the performance of the chemical conversion film; thus compared with the use of manganese ion alone, the coating adhesion and corrosion resistance are further enhanced.

When the fluorine compound concentration (in terms of HF) is less than 0.05 g/L, the variation in bath composition is increased so that no consistently satisfactory film may be obtained. When it exceeds 3 g/L, no commensurate effect can be obtained, resulting in an economic disadvantage.

The acidic zinc phosphate solution mentioned above may contain 3 to 30 g/L, preferably 3 to 15 g/L, of nitrate ion. If the nitrate ion amount exceeds 30 g/L, thin spots and yellow rust may develop in the phosphate film.

The concentrations of ions in said acidic zinc phosphate treating agent as mentioned in this specification are determined with Ion Chromatograph Series 4000 (manufactured by Dionex) or Atomic Absorption Spectrometer 3300 (manufactured by Perkin Elmer).

In the metal surface-treating method of the invention, the free acidity of the treating agent is preferably 0.5 to 2.0 points. The free acidity of the treating agent can be found by sampling 10 mL of the treating agent and carrying out a titration with 0.1 N sodium hydroxide using bromophenol blue as an indicator. If the value is less than 0.5 point, the stability of the treating agent may not be as high as desired. If it exceeds 2.0 points, the corrosion resistance as evaluated by the salt spray test tends to be decreased.

The aqueous zinc nitrite solution as said accelerator is preferably formulated so that said acidic aqueous zinc phosphate solution will be provided with 0.05 to 0.3 g/L of $NO_2$. If it is less than 0.05 g/L, there will be cases in which the chemical conversion becomes insufficient. On the other hand, if it exceeds 0.3 g/L, the impurity sodium and sulfate ion amount in the treating agent will be elevated to adversely affect the quality of the chemical conversion film.

In the management of the $NO_2$ concentration of the treating agent in the metal surface-treating method of the invention, it is necessary to maintain $NO_2$ within a defined concentration range, which is specific to the particular treating line used, with said aqueous zinc nitrite solution and this can be achieved by supplementing the treating bath with said aqueous zinc nitrite solution either continuously or periodically. The addition rate of zinc nitrite is usually set in relation to the measured $NO_2$ concentration of the acidic aqueous zinc phosphate treating agent.

The $NO_2$ concentration of said acidic aqueous zinc phosphate solution can be measured by the method in routine use as a practical technique in the phosphating industry, namely by using Einhorn's tube in use in fermentation industry or the like apparatus and solid sulfamic acid to expediently cause nitrogen to evolve quantitatively from zinc nitrite and be trapped and calculate the concentration of $NO_2$ in the treating agent from the trapped amount of nitrogen (Japanese Kokai Publication Sho-51-88442). The value found by the above technique is known as the toner value and one point of the value corresponds to about 44 mg/L of $NO_2$ concentration.

Since, in accordance with the present invention, a satisfactory chemical conversion film can be obtained when the sodium ion concentration in the chemical conversion agent is 7500 ppm on a weight basis, an aqueous solution of sodium nitrite, which is inexpensive, can be added in admixture with said aqueous zinc nitrate solution as far as the sodium ion concentration in the chemical conversion bath will be maintained within the above-mentioned range. In such cases, too, it is necessary that the accelerator to be added should be substantially free of calcium ion and contain sulfate ion in a concentration of 0 to 20 ppm assuming the concentration of the aqueous accelerator solution to be 10 weight % as $NO_2$.

While the metal surface-treating method of the invention can be applied to panels and shaped products of metals, it is particularly suited to the surface treatment of a shaped product having heterogeneous metal surfaces such as a zinc type metallic surface and an iron type metallic surface or an iron type surface, a zinc type surface and an aluminum type surface or a shaped product having an intricate shape, such as an automotive body. In the treatment of such metal surfaces, the use of said aqueous zinc nitrite solution as an accelerator helps prevent accumulation of sodium ion and stabilize chemical conversion so that untoward results such as a decrease in corrosion resistance due to a difference in the susceptibility to treatment between dissimilar metals or a decrease of chemical conversion of recessed surfaces can be avoided.

The metal surface-treating method of the invention comprises treating a substrate metal surface in a dip chemical conversion system using the above-described treating agent and, as a chemical conversion accelerator, the above-described aqueous zinc nitrite solution. As to the temperature at which the metal surface treatment is carried out, the ordinary treating temperature can be used; for example, a suitable temperature can be judiciously selected from the range of 20 to 70° C. The time necessary for consummation of the above metal surface treatment may generally be not less than 10 seconds, preferably not less than 30 seconds, more preferably 1 to 3 minutes.

In the treatment of a shaped product having an intricate geometry with many recessed surfaces, such as an automotive body, the preferred procedure comprises carrying out the above-mentioned dip treatment and, then, performing a spray treatment for not less than 2 seconds, preferably 5 to 45 seconds. This spray treatment is preferably carried out for a sufficiently long time in order that the sludge deposited on the surface in the dip treatment may be flushed off. The present invention involves not only the above dip treatment but also the spray treatment described just above.

While the treatment according to the method of the invention may be carried out using any of the pretreatment systems heretofore in routine use, the particularly preferred treatment system is a closed system including a reverse osmosis treatment or an evaporation treatment or a pretreatment system adapted to reduce cleaning water requirements. In such systems, the unwanted accumulation of sodium ion, which has heretofore been a serious problem, can now be drastically reduced so that a high conversion efficiency surpassing that of the conventional metal surface-treating technology can be sustainedly achieved over a longer time, thus helping to drastically reduce the frequency of renewal of the treating agent or even eliminate the need for such renewal.

As mentioned above, the aqueous zinc nitrite solution is such that, assuming the concentration thereof in terms of $NO_2$ to be 10 weight %, the amount of sodium ion therein has been reduced to 6500 ppm or less and that of sulfate ion therein to 20 ppm or less and further that it is substantially free of calcium ion. The metal surface-treating method of the invention using such an aqueous zinc nitrite solution as an accelerator, therefore, features a reduced incidence of sludge formation and a very high treatment efficiency even when applied to a closed system, and is particularly suitable for the metal surface treatment of shaped products having both a zinc type metallic surface and an iron type metallic surface or shaped products having an iron type surface, a zinc type surface and an aluminum type surface or shaped products having intricate geometry with many recessed surfaces, such as automotive bodies.

The metal surface-treating method of the invention provides a satisfactory zinc phosphate film and can be applied even to a closed system successfully. The zinc phosphate film obtainable by the metal surface-treating method of the invention is suitable for the cationic electrocoating of shaped products having both an iron type metallic surface and a zinc type metallic surface or an iron type surface, a zinc type surface and an aluminum type surface.

EXAMPLES

The following examples illustrate the present invention in further detail, it being to be understood that the invention are by no means defined by these specific examples. In these examples, all parts and percents (%) are by weight.

Preparation Example 1

Preparation of an Aqueous Zinc Nitrite Solution

In a 5-cell electrodialyzer using ion exchange membranes as diaphragms as illustrated in FIG. 1, an anion exchange membrane (Selemion AMV; product of Asahi Glass Co.) Al, a cation exchange membrane (Selemion CMV, product of Asahi Glass Co.) C1, another unit of the same anion exchange membrane as above, A2, and another unit of the same cation exchange membrane as above, C2, were arranged in that order from the anode side to the cathode side, with said membranes and electrodes defining an anode compartment, a demineralizing compartment (I), a concentrating compartment (I), a demineralizing compartment (II) and a cathode compartment. In the above setup, the $NO_2$ ion and Zn ion were selectively caused to migrate through the above anion exchange membranes and cation exchange membranes, respectively, to obtain an aqueous zinc nitrite solution. The experiment protocol was as follows.

In deionized water was dissolved 575 g of zinc sulfate ·7 $H_2O$ to prepare a 15% aqueous solution of $ZnSO_4$ and this solution was fed to the demineralizing compartment (I). On the other hand, 600 g of sodium nitrite was dissolved in deionized water to prepare a 30% aqueous solution of $NaNO_2$ and this solution was fed to the demineralizing compartment (II).

A 1.7% aqueous solution of zinc nitrite was placed in the concentrating compartment (I). The anode compartment and the cathode compartment were supplied with a 3% aqueous solution of $Na_2SO_4$. As said anion exchange and cation exchange membranes, each having an effective membrane area of about 120 $cm^2$ was used. While the solutions were circulated with pump means to maintain the concentration of the solution in each compartment at a constant amount, a voltage of 5 V was applied to the ion exchange membranes to carry out an ion exchange double decomposition reaction for 40 hours, whereby an aqueous solution of zinc nitrite was obtained. In the resulting aqueous solution of zinc nitrite [$Zn(NO_2)_2$], the concentration of zinc nitrite was 17.7% and, assuming that the concentration of said aqueous zinc nitrite solution to be 10% weight as $NO_2$, the sodium ion amount was 1188 ppm, the sulfate ion amount was 10 ppm, and the calcium ion amount was not higher than 1 ppm.

| A chemical conversion agent and the treatment of metal surfaces To a surface-treating agent of the following composition: | |
|---|---|
| Zinc ion: | 1000 ppm |
| Nickel ion: | 1000 ppm |
| Manganese ion: | 600 ppm |
| $SiF_6$: | 1000 ppm |
| Nitrate ion: | 6000 ppm |
| Phosphate ion: | 15000 ppm, |

an aqueous $NaNO_2$ solution of 27 weight % $NO_2$ concentration and, in some runs, the aqueous zinc nitrite solution prepared in Preparation Example 1 were added so as to maintain the $NO_2$ concentration at a constant amount as described in Reference Example 1, Reference Example 2, Example 2 and Example 3, and a long-term treatment was carried out under the following treating conditions and the following evaluations were made for various parameters.

| Treating conditions | |
|---|---|
| Free acidity: | 0.8 point |
| Total acid: | 20 to 22 mL |
| Treating temperature: | 43 ± 2° C. |
| Toner value: | 2.5 to 3.0 points |

The free acidity of the treating agent was determined by sampling 10 mL of the treating agent and carrying out a titration with 0.1 N sodium hydroxide using bromophenol blue as an indicator.

The total acid of the treating agent was determined by sampling 10 mL of the treating agent with a pipette, carrying out a titration with 0.1 N sodium hydroxide using phenolphthalein as an indicator, and taking the amount (mL) of 0.1 N sodium hydroxide required to cause a change in color to pink as total acid.

Parameters Evaluated

1. Na ion in the bath: determined with Atomic Absorption Spectrometer 3300 (manufactured by Perkin Elmer)
2. Appearance of chemical conversion film: evaluated visually.
3. Weight of chemical conversion film: determined by fluorescent X-ray analysis (System 3070E, manufactured by Rigaku).
4. Crystal size of chemical conversion film: determined by SEM (×1500) (JSM-5310, manufactured by JEOL).

Example 1

Influence of the Sodium Ion Concentration of the Surface-treating Agent

In the above surface-treating agent, the sodium ion concentration was varied and an evaluation was made using the following iron panel.

Iron panel (size/type): 70 mm×150 mm/SPC (cold-rolled steel panel) and GA (galvanized steel panel).

The results with the SPC steel panel are shown in Table 1 and those with the GA steel panel are shown in Table 2.

TABLE 1

Investigation of the relation between sodium ion concentration and chemical conversion film (SPC steel panel)

| Sodium conc. | 3600 ppm | 5000 ppm | 7500 ppm | 10000 ppm |
|---|---|---|---|---|
| Appearance, visual | Wholesome | Wholesome | Wholesome | Poor |
| Film weight | 2.12 | 2.37 | 2.28 | 2.72 |
| Crystal size | Uniform, good | Uniform, good | Uniform, good | Not uniform, large |

TABLE 2

Investigation of the relation between sodium ion concentration and chemical conversion film (GA steel panel)

| Sodium conc. | 3600 ppm | 5000 ppm | 7500 ppm | 10000 ppm |
|---|---|---|---|---|
| Appearance, visual | Wholesome | Wholesome | Wholesome | Poor |
| Film weight | 3.32 | 3.58 | 3.57 | 4.50 |
| Crystal size | Uniform, good | Uniform, good | Uniform, good | Large |

Reference Example 1

Measurement of Na Ion Accumulation-1 (Aqueous $NaNO_2$ Solution)

SPC panels (70 mm×150 mm) were treated under the above treating conditions except that the components (phosphoric acid, zinc, etc.) consumed as the film were replenished.

Amounts of solutions in an ordinary line

A: chemical conversion tank capacity: 120 tons

B: the amount of $NaNO_2/H_2O$ ($NO_2$ concentration: 27 weight %, sodium ion concentration: 13 weight %) used per body: 150 mL C: the amount of zinc used per body: 60 g D: the carry-over loss of chemical conversion agent per body: 5 L (carry-over loss per panel 2 mL; treatment of 2500 panels)

Using the above process as 1 turnover, a total of 7500 panels were treated in 3 repeats (3 turnovers). When the carry-over loss of the chemical conversion agent was not recovered, the aqueous $NaNO_2$ solution had a $NO_2$ concentration of 27 weight % and a sodium ion concentration of 13 weight %, and the sodium ion concentration in the chemical conversion tank was steady at 3900 ppm. It is clear from the results of Example 1 that a satisfactory chemical conversion film can be obtained at the sodium ion concentration of 3900 ppm.

Reference Example 2

Measurement of Na Ion Accumulation-2 (Aqueous $NaNO_2$ Solution)

The carry-over loss, 5 L, of chemical conversion agent in Reference Example 1 was diluted with 45 L of industrial water at pH 6.8 with an electrical conductivity of 234 $\mu$S/cm for use as an overflow cleaning water model. This model water was adjusted to pH 3 and using Membrane Master RUW-5A (manufactured by Nitto Denko) carrying a commercial LF10 Module as a reverse osmosis unit, a reverse osmosis treatment was carried out at a treating temperature of 25 to 30° C., a pressure of 1.0 to 1.1 MPa, a concentrate circulation flow rate of 6.2 to 6.3 L/min, and a filtrate flow rate of 0.3 to 0.6 L/min to give 5 L of concentrate and 45 L of filtrate. The sodium ion recovery rate of the concentrate was 93%.

Then, the recovered concentrate was returned to the chemical conversion agent. With the above treatment being taken as 1 turnover, a total of 7500 panels were treated in 3 repeats (3 turnovers).

When the same aqueous $NaNO_2$ solution as used in Reference Example 1 ($NO_2$ concentration: 27 weight %, Na ion concentration: 13 weight %) was used, the concentration continued to rise with time and ultimately the sodium ion amount reached 56000 ppm. It is clear from the results of Example 1 that no satisfactory chemical conversion film can be obtained at this sodium ion amount of 56000 ppm.

Example 2

Measurement of Na Ion Accumulation (Aqueous Zn $(NO_2)_2$ Solution)

When the aqueous zinc nitrite solution obtained in Preparation Example 1 was used, addition of 389 mL per body was required to attain the same $NO_2$ concentration as in Reference Example 1. In this case, zinc was added theoretically in an amount of 28 g and be consumed as the chemical conversion film. When the reverse osmosis treatment described in Reference Example 2 was carried out, the accumulation of sodium ion reached 1320 ppm.

Example 3

Measurement of Na Ion Accumulation (Aqueous $NaNO_2$ Solution and Aqueous $Zn(NO_2)_2$ Solution)

When the aqueous $NaNO_2$ solution of Reference Example 1 and the aqueous zinc nitrite solution of Preparation Example 1 were used in a ratio of 8/92 in terms of $NO_2$, the addition amount was 12 mL/358 mL (sodium ion: 2.00 g). When the reverse osmosis treatment according to Reference Example 2 was carried out, the sodium ion concentration in the chemical conversion bath became 5700 ppm (recovery rate 93%).

It can be seen that by using the aqueous $NaNO_2$ solution of Reference Example 1 and the aqueous zinc nitrite solution of Preparation Example 1 in a ratio of 8/92 in terms of $NO_2$, the sodium ion concentration in the chemical conversion bath can be controlled within the proper range (3600 to 7500 ppm)

What is claimed is:

1. A process for treating a substrate having a metal surface comprising the step of contacting the metal surface with an acidic aqueous zinc phosphate solution, wherein an aqueous zinc nitrite solution is used as an accelerator, said aqueous zinc nitrite solution being substantially free of calcium ion and containing 0 to 6500 ppm of sodium ion 0 to 20 ppm of sulfate ion.

2. The process according to claim 1, wherein said acidic aqueous zinc phosphate solution contains 0.5 to 2 g/L of zinc ion, 5 to 30 g/L of phosphate ion, 0.2 to 2 g/L of manganese ion, and 0.05 to 0.3 g/L as $NO_2$ zinc nitrite.

3. The process according to claim 1, wherein said acidic aqueous zinc phosphate solution contains 0.3 to 2 g/L of nickel ion.

4. The process according to claim 1, wherein said acidic aqueous zinc phosphate solution contains 3 to 30 g/L of nitrate ion.

5. The process according to claim 1, wherein said the substrate is a shaped product having an iron surface and a zinc surface, or a shaped product having an iron surface, a zinc surface and an aluminum surface.

6. The process according to claim 2, wherein said acidic aqueous zinc phosphate solution contains 0.3 to 2 g/L of nickel ion.

7. The process according to claim 2, wherein said acidic aqueous zinc phosphate solution contains 3 to 30 g/L of nitrate ion.

8. The process according to claim 3, wherein said acidic aqueous zinc phosphate solution contains 3 to 30 g/L of nitrate ion.

9. The process according to claim 2, wherein the substrate is a shaped product having an iron surface and a zinc surface, or a shaped product having an iron surface, a zinc surface and an aluminum surface.

10. The process according to claim 3, wherein the substrate is a shaped product having an iron surface and zinc surface, or a shaped product having an iron surface, a zinc surface and an aluminum surface.

11. The process according to claim 4, wherein the substrate is a shaped product having an iron surface and a zinc surface, or a shaped product having an iron surface, a zinc surface and an aluminum surface.

* * * * *

UNITED STATES PATENT AND TRADEMARK OFFICE

CERTIFICATE OF CORRECTION

PATENT NO. : 6,458,219 B2
DATED : October 1, 2002
INVENTOR(S) : Chihara, Hiroshi et al.

It is certified that error appears in the above-identified patent and that said Letters Patent is hereby corrected as shown below:

Column 12,
Line 8, should read -- 6500 ppm of sodium ion and 0 to 20 ppm of sulfate ion, --
Line 12, should read -- ion, and 0.05 to 0.3 g/L as $NO_2$ of zinc nitrite. --

Signed and Sealed this

Twenty-fifth Day of February, 2003

JAMES E. ROGAN
*Director of the United States Patent and Trademark Office*